US012156553B2

(12) United States Patent
Hull

(10) Patent No.: US 12,156,553 B2
(45) **Date of Patent: *Dec. 3, 2024**

(54) SAFETY GLOVE WITH FINGERTIP PROTECTIVE MEMBER

(71) Applicant: Summit Glove Inc., Minerva, OH (US)

(72) Inventor: James L. Hull, Malvern, OH (US)

(73) Assignee: SUMMIT GLOVE INC., Minerva, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,392

(22) Filed: Jan. 31, 2024

(65) Prior Publication Data

US 2024/0225148 A1 Jul. 11, 2024

Related U.S. Application Data

(63) Continuation of application No. 17/695,509, filed on Mar. 15, 2022, now Pat. No. 11,925,222, which is a continuation-in-part of application No. 17/533,968, filed on Nov. 23, 2021, now Pat. No. 11,641,894, which is a continuation of application No. 16/135,266, filed on Sep. 19, 2018, now Pat. No. 11,219,253, which is a continuation-in-part of (Continued)

(51) Int. Cl.

| | |
|---|---|
| ***A41D 19/015*** | (2006.01) |
| ***A41D 13/08*** | (2006.01) |
| ***A41D 19/00*** | (2006.01) |

(52) U.S. Cl.

CPC ..... *A41D 13/087* (2013.01); *A41D 19/0006* (2013.01); *A41D 19/0051* (2013.01); *A41D 19/0096* (2013.01); *A41D 19/01505* (2013.01); *A41D 19/01517* (2013.01); *A41D 19/01558* (2013.01); *A41D 2400/70* (2013.01); *A41D 2600/20* (2013.01)

(58) Field of Classification Search

CPC ..... A41D 19/006; A41D 19/0051; A41D 19/0096; A41D 19/01505; A41D 19/01517; A41D 19/01558

See application file for complete search history.

(56) References Cited

U.S. PATENT DOCUMENTS

| | | | |
|---|---|---|---|
| 811,096 | A | 1/1906 | Scott |
| 1,153,728 | A | 9/1915 | Taylor |

(Continued)

*Primary Examiner* — Bao-Thieu L Nguyen

(74) *Attorney, Agent, or Firm* — Sand, Sebolt & Wernow Co., LPA

(57) ABSTRACT

A safety glove having a protective member or insert extending around the fingertip of the safety glove is provided. The protective member may be positioned along the outer surface or the inner surface of the glove. Alternatively, the protective member may be integrally formed between two layers of glove material. The protective member terminates distally from an interphalangeal joint line to enable finger flexion in order to grasp an item, such as a slab of meat to be deskinned in a skinning machine. The glove may include a rough outer surface formed from thrice dipping the glove and allowing the glove to cure. Additionally, the glove may have a width near the wrist that is wider than the width near the palm to enable the glove to be rapidly removed (i.e., doffed) in an emergency event of the glove getting caught in a rotating blade on the skinning machine.

18 Claims, 11 Drawing Sheets

Related U.S. Application Data application No. 15/185,097, filed on Jun. 17, 2016, now Pat. No. 10,143,248.

(60) Provisional application No. 62/181,967, filed on Jun. 19, 2015.

(56) References Cited

U.S. PATENT DOCUMENTS

| | | | |
|---|---|---|---|
| 1,483,595 | A | 2/1924 | Read |
| 1,673,517 | A | 6/1928 | Kurz |
| 2,114,022 | A | 1/1935 | Jensen |
| 2,001,961 | A | 5/1935 | Jensen |
| 2,040,137 | A | 5/1936 | Jensen |
| 2,041,201 | A | 5/1936 | Neback |
| 2,067,790 | A | 1/1937 | Sager |
| 2,067,791 | A | 1/1937 | Sager |
| 2,142,788 | A | 1/1939 | Jensen |
| 2,582,240 | A | 1/1952 | Dumas |
| 2,849,786 | A | 9/1958 | Ashley et al. |
| 3,633,216 | A | 1/1972 | Schonholtz |
| 3,997,922 | A | 12/1976 | Huhta |
| 4,032,990 | A | 7/1977 | Mandlman |
| 4,061,709 | A | 12/1977 | Miller et al. |
| 4,172,293 | A | 10/1979 | Vistins |
| 4,295,229 | A | 10/1981 | Clark et al. |
| 4,454,611 | A | 6/1984 | Tschirch et al. |
| 4,519,098 | A | 5/1985 | Dunmire et al. |
| 4,524,464 | A | 6/1985 | Primiano et al. |
| 4,589,233 | A | 5/1986 | Parekh |
| 4,589,940 | A | 5/1986 | Johnson |
| 4,594,736 | A | 6/1986 | Connelly |
| 4,658,441 | A | 4/1987 | Smith |
| 4,694,508 | A | 9/1987 | Iriyama et al. |
| 4,696,065 | A | 9/1987 | Elenteny |
| 4,709,694 | A | 12/1987 | O'Connell |
| 4,742,578 | A | 5/1988 | Seid |
| 4,779,289 | A | 10/1988 | Prouty |
| 4,779,290 | A | 10/1988 | Welch et al. |
| 4,785,479 | A | 11/1988 | Watanabe |
| 4,833,733 | A | 5/1989 | Welch et al. |
| 4,873,998 | A | 10/1989 | Joyner |
| 4,894,866 | A | 1/1990 | Walker |
| 4,910,803 | A | 3/1990 | Cukier |
| 4,942,626 | A | 7/1990 | Stern et al. |
| 4,987,611 | A | 1/1991 | Maye |
| 4,995,119 | A | 2/1991 | Codkind |
| 5,070,540 | A | 12/1991 | Bettcher et al. |
| 5,083,973 | A | 1/1992 | Townsend |
| 5,093,933 | A | 3/1992 | Berry |
| 5,113,532 | A | 5/1992 | Sutton |
| 5,168,578 | A | 12/1992 | Stanley |
| 5,187,815 | A | 2/1993 | Stern et al. |
| 5,224,363 | A | 7/1993 | Sutton |
| 5,231,700 | A | 8/1993 | Cutshall |
| 5,345,608 | A | 9/1994 | Mergens et al. |
| 5,384,083 | A | 1/1995 | Dawn et al. |
| 5,402,536 | A | 4/1995 | Matthews |
| 5,500,957 | A | 3/1996 | Stein |
| 5,561,856 | A | 10/1996 | Pesco |
| 5,564,127 | A | 10/1996 | Manne |
| 5,588,651 | A | 12/1996 | Frost |
| 5,604,934 | A | 2/1997 | Willett |
| 5,685,014 | A | 11/1997 | Dapsalmon |
| 5,697,104 | A | 12/1997 | Welton |
| D389,608 | S | 1/1998 | Kraatz |
| 5,708,979 | A | 1/1998 | Redwood et al. |
| 5,745,919 | A | 5/1998 | Kraatz |
| 5,758,569 | A | 6/1998 | Barbour |
| 5,770,297 | A | 6/1998 | Grubich |
| 5,817,365 | A | 10/1998 | Richardson et al. |
| 5,817,433 | A | 10/1998 | Darras |
| 5,857,216 | A | 1/1999 | Gold |
| 5,867,830 | A | 2/1999 | Chen |
| 5,974,588 | A | 11/1999 | Furman |
| 6,012,170 | A | 1/2000 | Kim |
| 6,142,064 | A | 11/2000 | Backus et al. |
| 6,145,128 | A | 11/2000 | Suzuki |
| 6,154,885 | A | 12/2000 | Kobayashi et al. |
| 6,260,203 | B1 | 7/2001 | Battle |
| 6,279,166 | B1 | 8/2001 | Schild |
| 6,314,869 | B1 | 11/2001 | Bourgeois et al. |
| 6,341,376 | B1 | 1/2002 | Smerdon, Jr. |
| 6,360,373 | B1 | 3/2002 | Rehn et al. |
| 6,427,246 | B1 | 8/2002 | Doi et al. |
| 6,449,772 | B1 | 9/2002 | Donner |
| 6,457,182 | B1 | 10/2002 | Szczesuil et al. |
| 6,495,612 | B1 | 12/2002 | Corzani et al. |
| 6,496,984 | B1 | 12/2002 | Chow |
| 6,539,522 | B1 | 4/2003 | Yoshida |
| 6,651,255 | B1 | 11/2003 | Schild |
| 6,711,746 | B1 | 3/2004 | Orellana |
| 6,721,960 | B1 | 4/2004 | Levesque et al. |
| 6,760,924 | B2 | 7/2004 | Hatch et al. |
| 6,871,359 | B2 | 3/2005 | Han |
| 6,898,819 | B2 | 5/2005 | Tanaka et al. |
| 6,973,675 | B2 | 12/2005 | Cheng |
| 7,021,204 | B2 | 4/2006 | Backus et al. |
| 7,037,579 | B2 | 5/2006 | Hassan et al. |
| 7,048,884 | B2 | 5/2006 | Woodford et al. |
| 7,062,791 | B2 | 6/2006 | Gold |
| 7,089,600 | B2 | 8/2006 | Morita |
| D530,455 | S | 10/2006 | Contant et al. |
| D533,969 | S | 12/2006 | Contant et al. |
| D537,211 | S | 2/2007 | Contant et al. |
| 7,284,283 | B2 | 10/2007 | Mack et al. |
| 7,377,566 | B2 | 5/2008 | Gazaui et al. |
| 7,380,288 | B1 | 6/2008 | Duncan |
| 7,383,590 | B1 | 6/2008 | Duncan |
| 7,431,671 | B1 | 10/2008 | Frost |
| 7,469,426 | B2 | 12/2008 | Roeckl |
| 7,480,945 | B2 | 1/2009 | Knuth et al. |
| 7,527,828 | B2 | 5/2009 | Hassan et al. |
| 7,725,979 | B1 | 6/2010 | Held et al. |
| D622,030 | S | 8/2010 | Thompson |
| 7,771,644 | B2 | 8/2010 | Flather et al. |
| 7,836,839 | B2 | 11/2010 | Park |
| 7,963,864 | B2 | 6/2011 | Frost |
| 8,001,809 | B2 | 8/2011 | Thompson et al. |
| 8,104,097 | B2 | 1/2012 | Hamann |
| 8,119,200 | B2 | 2/2012 | Kassam et al. |
| 8,137,606 | B2 | 3/2012 | Thompson et al. |
| 8,146,173 | B2 | 4/2012 | Kim |
| 8,192,834 | B2 | 6/2012 | Woodford et al. |
| 8,413,469 | B2 | 4/2013 | Lapp et al. |
| 8,656,518 | B2 | 2/2014 | Saunders et al. |
| 8,709,573 | B2 | 4/2014 | Hassan et al. |
| 8,852,033 | B1 | 10/2014 | Frost |
| 8,863,316 | B2 | 10/2014 | Gaskins |
| 8,863,317 | B2 | 10/2014 | Tsuru et al. |
| 9,198,474 | B1 | 12/2015 | Haccobian |
| 9,456,645 | B2 | 10/2016 | Ghazaly et al. |
| 9,538,797 | B2 | 1/2017 | Jones et al. |
| 9,549,579 | B2 | 1/2017 | Bailey |
| 9,549,836 | B2 | 1/2017 | Anglada et al. |
| 9,585,426 | B2 | 3/2017 | Megat Abdul Aziz et al. |
| 9,609,900 | B2 | 4/2017 | Schild |
| 9,610,610 | B2 | 4/2017 | Ahmed et al. |
| 9,781,959 | B2 | 10/2017 | Pimentel De Oliveira et al. |
| 9,877,528 | B2 | 1/2018 | Hassan et al. |
| 9,888,733 | B2 | 2/2018 | Hull |
| 10,111,477 | B1 | 10/2018 | Ballas |
| 10,143,248 | B2 | 12/2018 | Hull |
| 10,149,504 | B2 | 12/2018 | Kassam et al. |
| 10,253,170 | B2 | 4/2019 | Lucas et al. |
| 10,292,440 | B2 | 5/2019 | Fernando et al. |
| 10,349,690 | B2 | 7/2019 | Francisco Costa et al. |
| 10,350,848 | B2 | 7/2019 | Loo et al. |
| 10,500,797 | B2 | 12/2019 | Loo et al. |
| 10,626,283 | B2 | 4/2020 | Mercado et al. |
| 10,645,984 | B2 | 5/2020 | Hull |
| 10,662,579 | B2 | 5/2020 | Sandakelum et al. |
| 10,681,944 | B2 | 6/2020 | Hull |
| 10,750,803 | B2 | 8/2020 | Hull |
| 10,765,157 | B2 | 9/2020 | Hull |

(56) References Cited

U.S. PATENT DOCUMENTS

| | | | | |
|---|---|---|---|---|
| 10,980,295 | B2 | 4/2021 | Hull | |
| 11,047,069 | B2 | 6/2021 | Dapsalmon | |
| 11,166,502 | B2 | 11/2021 | Hull | |
| 11,219,253 | B2 | 1/2022 | Hull | |
| 11,925,222 | B2 * | 3/2024 | Hull | A41D 13/087 |
| 2002/0042940 | A1 | 4/2002 | Kuroda et al. | |
| 2003/0005507 | A1 | 1/2003 | Litke | |
| 2003/0079279 | A1 | 5/2003 | Genkins | |
| 2003/0134063 | A1 | 7/2003 | Vance et al. | |
| 2003/0140396 | A1 | 7/2003 | Vero et al. | |
| 2004/0060096 | A1 | 4/2004 | Thiruppathi | |
| 2004/0187189 | A1 | 9/2004 | Morita | |
| 2005/0005338 | A1 | 1/2005 | Lewis | |
| 2005/0028244 | A1 | 2/2005 | Roeckl | |
| 2005/0035493 | A1 | 2/2005 | Flather et al. | |
| 2005/0284306 | A1 | 12/2005 | Backus et al. | |
| 2006/0090771 | A1 | 5/2006 | Ramet | |
| 2006/0150299 | A1 | 7/2006 | Geng | |
| 2006/0150300 | A1 * | 7/2006 | Hassan | A41D 19/01547 2/161.6 |
| 2007/0083980 | A1 | 4/2007 | Yang et al. | |
| 2007/0118967 | A1 | 5/2007 | Flather et al. | |
| 2007/0192929 | A1 | 8/2007 | Flather et al. | |
| 2008/0052799 | A1 | 3/2008 | Yoo | |
| 2008/0081529 | A1 | 4/2008 | Gehring | |
| 2008/0120754 | A1 | 5/2008 | Raymond | |
| 2008/0216209 | A1 | 9/2008 | Kim | |
| 2009/0068443 | A1 | 3/2009 | Curtet et al. | |
| 2009/0077704 | A1 | 3/2009 | Duncan et al. | |
| 2009/0126074 | A1 | 5/2009 | Mattesky | |
| 2009/0139011 | A1 | 6/2009 | Vanermen et al. | |
| 2009/0158486 | A1 | 6/2009 | Cote et al. | |
| 2009/0271905 | A1 | 11/2009 | Alexander | |
| 2010/0005565 | A1 | 1/2010 | Park | |
| 2010/0024095 | A1 | 2/2010 | Gellis | |
| 2010/0095248 | A1 | 4/2010 | Fisher | |
| 2010/0104750 | A1 | 4/2010 | Kassam et al. | |
| 2010/0104762 | A1 | 4/2010 | Kassam et al. | |
| 2010/0186144 | A1 | 7/2010 | Zhu | |
| 2010/0186457 | A1 | 7/2010 | Zhu | |
| 2010/0275342 | A1 | 11/2010 | Sweeney et al. | |
| 2010/0325779 | A1 | 12/2010 | Matsunobu | |
| 2011/0099689 | A1 | 5/2011 | Taylor et al. | |
| 2011/0145967 | A1 | 6/2011 | Hull | |
| 2011/0185466 | A1 | 8/2011 | Loos | |
| 2011/0208321 | A1 | 8/2011 | Doddroe et al. | |
| 2011/0287553 | A1 | 11/2011 | Hassan et al. | |
| 2011/0289652 | A1 | 12/2011 | Thompson et al. | |
| 2012/0030856 | A1 | 2/2012 | Bevier | |
| 2012/0216377 | A1 | 8/2012 | Lin et al. | |
| 2012/0227158 | A1 | 9/2012 | Ashworth et al. | |
| 2012/0240308 | A1 | 9/2012 | Thompson | |
| 2012/0278964 | A1 | 11/2012 | Bormann-Early | |
| 2013/0061369 | A1 | 3/2013 | Lim | |
| 2013/0180022 | A1 | 7/2013 | Baungartger | |
| 2013/0219588 | A1 | 8/2013 | Nakagawa | |
| 2013/0254964 | A1 | 10/2013 | Robinson | |
| 2013/0319055 | A1 | 12/2013 | Tatsumi et al. | |
| 2014/0000006 | A1 | 1/2014 | Perera et al. | |
| 2014/0075639 | A1 | 3/2014 | Albertyn | |
| 2014/0137304 | A1 | 5/2014 | Katz | |
| 2014/0138968 | A1 | 5/2014 | Gentry et al. | |
| 2014/0157832 | A1 | 6/2014 | Thompson et al. | |
| 2014/0173805 | A1 | 6/2014 | Hassan et al. | |
| 2014/0237701 | A1 | 8/2014 | Thompson et al. | |
| 2014/0259283 | A1 | 9/2014 | Govindasamy et al. | |
| 2015/0020284 | A1 | 1/2015 | Hull | |
| 2015/0033441 | A1 | 2/2015 | Wikening et al. | |
| 2015/0037529 | A1 | 2/2015 | Loo et al. | |
| 2015/0087761 | A1 | 3/2015 | Satoh et al. | |
| 2015/0128329 | A1 | 5/2015 | Amarasekera et al. | |
| 2015/0143608 | A1 | 5/2015 | Loo et al. | |
| 2015/0143610 | A1 | 5/2015 | Pimentel de Oliveira et al. | |
| 2015/0164159 | A1 | 6/2015 | Hull | |
| 2015/0189932 | A1 | 7/2015 | Champagne et al. | |
| 2015/0272245 | A1 | 10/2015 | Khor et al. | |
| 2015/0313298 | A1 | 11/2015 | Bailey | |
| 2016/0029712 | A1 | 2/2016 | Hull | |
| 2016/0192721 | A1 | 7/2016 | Kishihara | |
| 2016/0213075 | A1 | 7/2016 | Omer | |
| 2016/0235138 | A1 | 8/2016 | Smith | |
| 2016/0270461 | A1 | 9/2016 | Carnes | |
| 2016/0325173 | A1 | 11/2016 | Leary | |
| 2016/0360808 | A1 | 12/2016 | Flather et al. | |
| 2017/0000201 | A1 | 1/2017 | Flather et al. | |
| 2017/0000202 | A1 | 1/2017 | Hassan et al. | |
| 2017/0055607 | A1 | 3/2017 | Francisco Costa et al. | |
| 2017/0099891 | A1 | 4/2017 | Hull | |
| 2017/0112204 | A1 | 4/2017 | Perera et al. | |
| 2017/0332714 | A1 | 11/2017 | Gutierrez et al. | |
| 2018/0064185 | A1 | 3/2018 | Gellis et al. | |
| 2018/0077980 | A1 | 3/2018 | Hull | |
| 2018/0103701 | A1 | 4/2018 | Hull | |
| 2018/0168252 | A1 | 6/2018 | Hull | |
| 2018/0230297 | A1 | 8/2018 | Kwon et al. | |
| 2018/0310650 | A1 | 11/2018 | Tseng et al. | |
| 2018/0333902 | A1 | 11/2018 | McGlothin et al. | |
| 2018/0370086 | A1 | 12/2018 | Zhang et al. | |
| 2019/0091898 | A1 | 3/2019 | Yamamoto et al. | |
| 2019/0270863 | A1 | 9/2019 | Leng et al. | |
| 2019/0343200 | A1 | 11/2019 | Cai et al. | |
| 2019/0374300 | A1 | 12/2019 | Mirtschin et al. | |
| 2020/0121479 | A1 | 4/2020 | Thompson et al. | |
| 2020/0221798 | A1 | 7/2020 | Hull | |
| 2020/0352266 | A1 | 11/2020 | Zhang et al. | |
| 2021/0301428 | A1 | 9/2021 | Dapsalmon | |
| 2022/0400784 | A1 | 12/2022 | Hull | |
| 2023/0301374 | A1 | 9/2023 | Hull | |
| 2024/0032630 | A1 | 2/2024 | Hull | |

* cited by examiner

SAFETY GLOVE WITH FINGERTIP PROTECTIVE MEMBER

CROSS REFERENCE TO RELATED APPLICATIONS

The present application is a continuation of U.S. patent application Ser. No. 17/695,509, filed Mar. 15, 2022, which is a continuation-in-part of U.S. patent application Ser. No. 17/533,968, filed on Nov. 23, 2021, now U.S. Pat. No. 11,641,894, which is a continuation application of U.S. patent application Ser. No. 16/135,266, filed on Sep. 19, 2018, now U.S. Pat. No. 11,219,253, which is a continuation-in-part of U.S. patent application Ser. No. 15/185,097, filed Jun. 17, 2016, now U.S. Pat. No. 10,143,248, which claims the benefit of Provisional Patent Application Ser. No. 62/181,967, filed Jun. 19, 2015. Each of the above applications are incorporated herein by reference.

TECHNICAL FIELD

The present disclosure relates generally to gloves. More particularly, the present disclosure is directed to work gloves for use in the food processing industry. Specifically, the present disclosure is directed to a protective work glove that includes an etched exterior layer which has improved abrasion resistance and a protective member integrally formed at the tip of each finger and thumb.

BACKGROUND

In many industries it is both desirable and necessary for workers to wear protective gloves. One of these industries is the food processing industry, particularly the meat packing industry. In the meat packing industry, many workers have to use knives during the performance of their jobs and, thus, there is a risk of accidentally cutting through the glove and injuring the worker's hand. It is therefore vital that a cut-resistance glove be worn in these particular occupations. Other workers use motorized machinery to perform tasks. One such machine is a deriding skinner which is utilized to simultaneously remove skin and a layer of fat from carcasses during meat processing. These skinners are configured to remove tough, thick layers of skin from a carcass. Consequently, workers gloves have to be strong and abrasion resistant so as to try and prevent a worker's hand from being badly hurt if it coming into contact with the blade region of a deriding skinner.

A number of patents are directed to protective gloves which are cut-resistant and abrasion resistant. For example, U.S. Pat. No. 4,172,293 and a protective glove commercially known as "Best Nitty Gritty" manufactured by Showa Best Glove of Menlo, Georgia.

SUMMARY

Issues continue to exist with protective gloves insofar as they still may lack adequate protection in the fingertip region. Thus, a need exists for an improved protective glove used in the meat packing industry. The present disclosure addresses these and other issues.

In one aspect, an embodiment of the present disclosure may provide a protective glove comprising: a flexible first layer; a hardened second layer; a flexible third layer; a tip of a finger region adapted to receive a user's finger therein; and wherein the hardened second layer is between the flexible first and third layers adjacent the tip of the finger region.

In another aspect, an embodiment of the present disclosure may provide a protective glove comprising: a distal tip of a finger region adapted to receive a user's finger therein; a flexible first layer extending over a distal tip of a finger region; a hardened second layer extending over the distal tip of the finger region and positioned entirely distal from an interphalangeal join plane; and an indicator layer extending over the distal tip of the finger region positioned between the first layer and the second layer, wherein the indicator layer provides a visual identifier to a user in the event that the flexible first layer is broken.

In another aspect, an embodiment may provide a method comprising the steps of: donning a protective work glove including a protective layer adjacent a tip of a finger region on the glove, wherein the protective layer is fabricated from a hardened material and is positioned between two layers of flexible material; skinning meat in a skinning device including a rotating blade; wherein the protective layer protects a user from injury if the protective work glove contacts the rotating blade.

In another aspect, an embodiment of the present disclosure may provide a protective glove comprising: a proximal wrist end opposite a distal fingertip end; a first finger sleeve including a distal tip; and a protective member adjacent the distal tip and positioned distal from an interphalangeal joint line, wherein the protective member is hardened relative to the first finger sleeve.

In another aspect, an embodiment of the present disclosure may provide a method comprising the steps of: donning a protective work glove including a protective layer adjacent a tip of a finger region on the glove, wherein the protective layer is fabricated from a hardened material and is positioned between two layers of flexible material; skinning meat in a skinning device including a rotating blade; and protecting a wearer from injury if the protective work glove contacts the rotating blade.

In another aspect, an embodiment of the present disclosure may provide a safety glove having a protective member or insert extending around the fingertip of the safety glove. The protective member may be positioned along the outer surface or the inner surface of the glove. Alternatively, the protective member may be integrally formed between two layers of glove material. The protective member terminates distally from an interphalangeal joint line to enable finger flexion in order to grasp an item, such as a slab of meat to be deskinned in a skinning machine. The glove may include a rough outer surface formed from thrice dipping the glove and allowing the glove to cure. Additionally, the glove may have a width near the wrist that is wider than the width near the palm to enable the glove to be rapidly removed (i.e., doffed) in an emergency event of the glove getting caught in a rotating blade on the skinning machine.

In yet another aspect, an exemplary embodiment of the present disclosure may provide a protective article comprising: a first end opposite a second end; a liner adapted to receive objects therein; an outer layer connected with the liner; and a protective member adjacent the second end that transitions from a liquid state to a solid state while forming the protective article. This exemplary embodiment or another exemplary embodiment may further provide wherein the protective member in a solid state is positioned between the liner and the outer layer. This exemplary embodiment or another exemplary embodiment may further provide wherein the protective article is a protective glove, and the protective glove includes: the first end is a proximal wrist end; the second end is a distal fingertip end; a longitudinal direction of the protective glove defined between the proximal wrist end and the distal fingertip end; a first finger sleeve including a distal tip; the liner defining a portion of the first finger sleeve; the outer layer connected with the liner defining a portion of the first finger sleeve; and the protective member adjacent the distal tip. This exemplary embodiment or another exemplary embodiment may further provide wherein the protective member in the solid state is positioned between the liner and the outer layer. This exemplary embodiment or another exemplary embodiment may further provide wherein the protective member in the solid state is hardened relative to the liner and the outer layer. This exemplary embodiment or another exemplary embodiment may further provide wherein the protective member includes a first end extending from the distal fingertip end to a second end that tapers towards the liner. This exemplary embodiment or another exemplary embodiment may further provide wherein the protective member in a solid state is positioned distal from an interphalangeal joint line of the first finger sleeve. This exemplary embodiment or another exemplary embodiment may further provide wherein the protective member in the liquid state covers a distal tip of the liner. This exemplary embodiment or another exemplary embodiment may further provide an indicator layer positioned between the protective member in the solid state and the outer layer. This exemplary embodiment or another exemplary embodiment may further provide wherein the indicator layer has a color that is different than that of the outer layer adapted to provide a visual indicator if the layer of material is ripped, torn, cut, or otherwise broken. This exemplary embodiment or another exemplary embodiment may further provide wherein the protective member that transitions from the liquid state to the solid state is formed from a material selected from the group comprising: natural rubber, acrylic, monomers, or polymers. This exemplary embodiment or another exemplary embodiment may further provide a two-way stretch direction of the liner that is not parallel to the longitudinal direction. This exemplary embodiment or another exemplary embodiment may further provide that the two-way stretch direction of the liner is orthogonal to the longitudinal direction and the liner does not include four-way stretch. This exemplary embodiment or another exemplary embodiment may further provide a two-way stretch direction of the liner that is not parallel to a longitudinal direction of the protective article measured from the first end to the second end, and the liner does not include four-way stretch.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
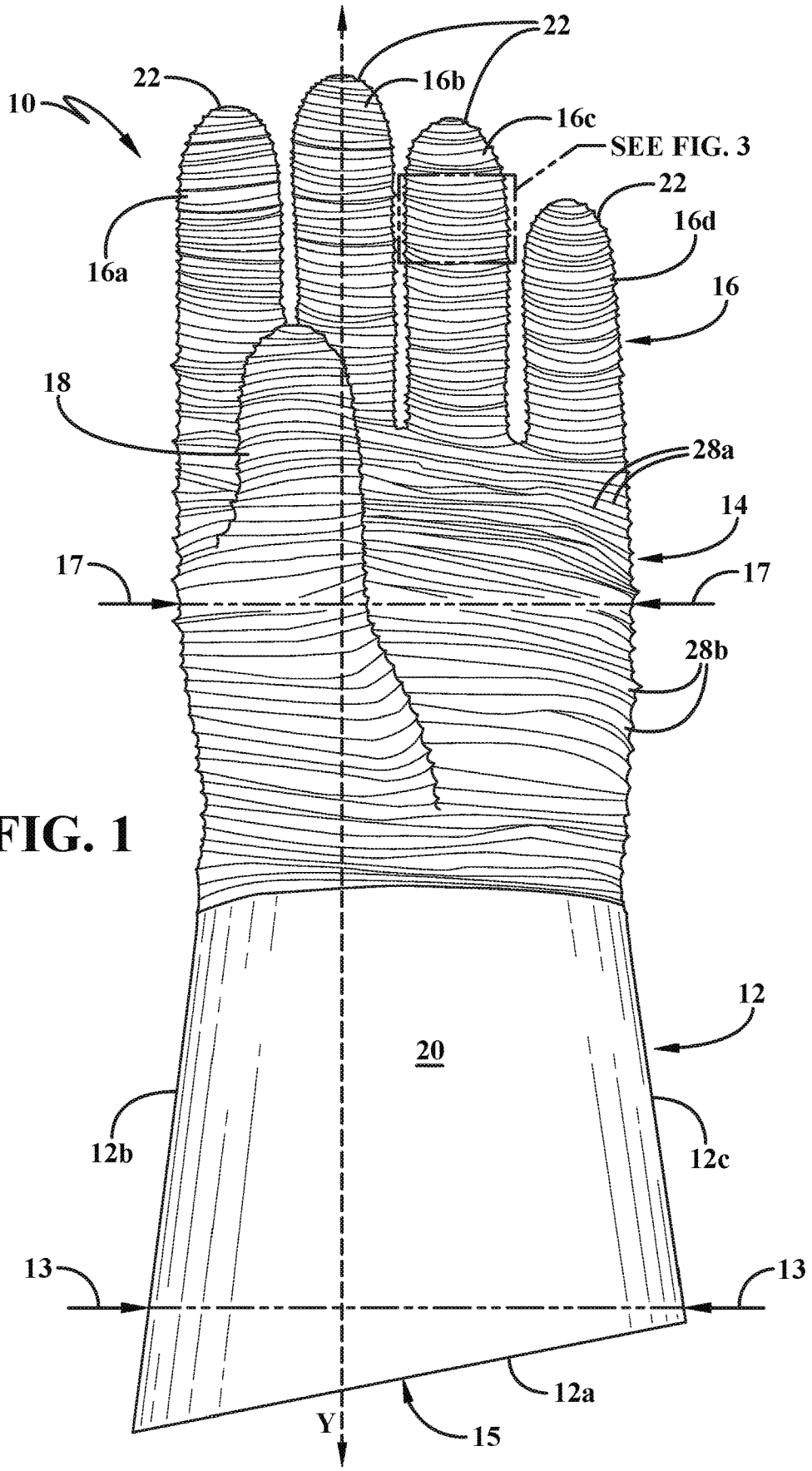
FIG. 1 is a front elevation view of a protective work glove in accordance with an aspect of the present invention.
Figure 2:
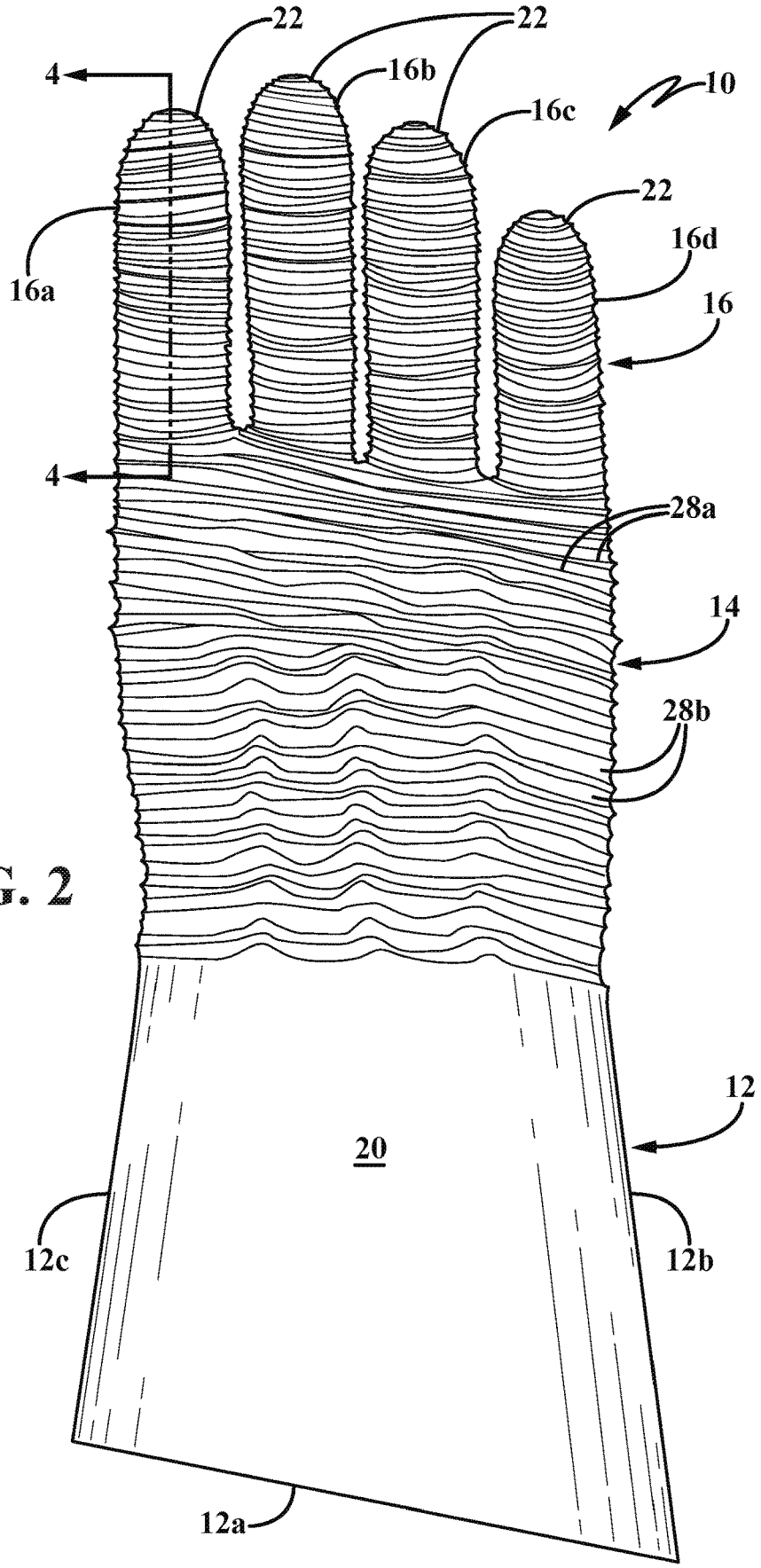
FIG. 2 is a rear elevation view of the protective work glove of FIG. 1.

Referring to FIGS. 1-6 there is shown a work glove in accordance with an aspect of the present invention, generally indicated at 10. Glove 10 comprises a wrist region 12, a palm region 14, finger regions 16 and a thumb region 18. Glove 10 is configured to receive a user's hand therein through an opening (not shown) but defined in a first end 12*a* of wrist region 12.

Wrist region 12 is configured to cover a portion of a user's wrist and forearm and first end 12*a* thereof is preferably angled such that a first side 12*b* of wrist region 12 is longer than a second side 12*c* thereof. First side 12*b* is that side which is located adjacent thumb region 18.

Wrist region 12 has a first width 13 when glove 10 is laid flat. The wrist region 12 width is widest portion of the glove 10 and defines an opening 15 through which a user or wearer is intended to insert their hand.

Palm region 14 is positioned distally from wrist region 12 and positioned proximal from first end 12*a*. Palm region 14 is configured to cover the palm of the user's hand and the back (i.e., dorsal portion) of their hand. Palm region 14 has a second width associated with it which may referred to as second width 17. Second width 17 is less than the first width 13 of the wrist region 12. As such, when glove 10 is laid flat, side edges 12*b*, 12*c* taper inwardly from wrist region 12 towards palm region 14. By enabling wrist region 12 to have a greater width than that of palm region 14, glove 10 is enabled to rapidly and easily be pulled from the wearer's hand. The rapid doffing may occur during the meat skinning process if the distal tip of the glove is caught in a rotating blade.

Finger region 16 extends distally outward from palm region 14 in a direction opposite to wrist region 12. Finger region 16 include the index finger region 16*a*, middle finger region 16*b*, ring finger region 16*c*, and little finger region 16*c*. The respective finger regions are defined by finger sleeve coverings formed of glove material. The finger sleeves are similarly labeled by reference numerals 16*a*, 16*b*, 16*c*, and 16*d*.

Thumb region 18 also extends outwardly from palm region 14 in a direction generally opposite to wrist region. Thumb region 18 is located in front of finger region 16.

Figure 4:
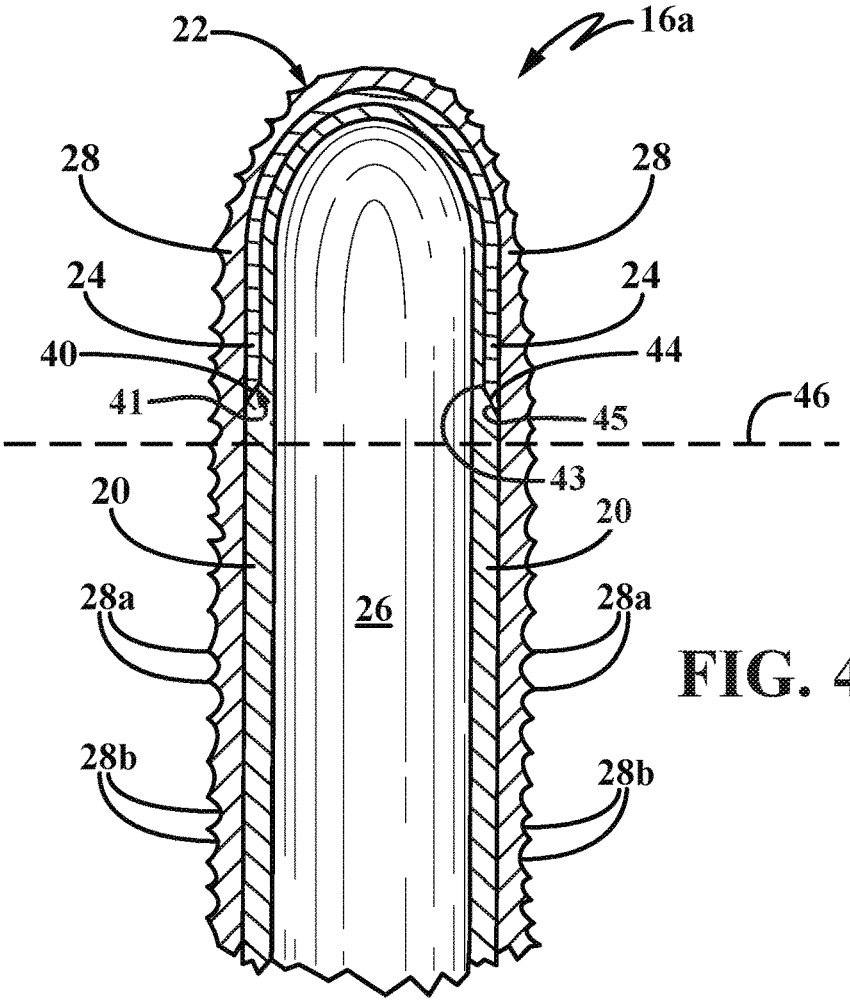
FIG. 4 is a longitudinal cross-section of a finger region of the work glove taken along line 4-4 of FIG. 2.

In accordance with an aspect of the present invention and as illustrated in FIG. 4, glove 10 may be fabricated from a first layer 20. First layer 20 forms part of every region of glove 10. Thus, first layer 20 is provided as part of wrist region 12, palm region 14, finger region 16 and thumb region 18. FIG. 1 shows that first layer 20 is the exterior layer covering most of wrist region 12. First layer 20 is of substantially the same thickness over the entire glove 10 with the exception of the tips of each respective finger region 16*a*, 16*b*, 16*c*, and 16*d*. As illustrated in FIG. 4, in the tip 22 of each digit, such as index finger region 16*a*, first layer 20 is thinner than over the rest of glove 10 and a protective member 24 of material is provided exteriorly of first layer 20. In one embodiment, the protective member 24 may be a hardened acrylic and provides additional protection in the tips 22 of each finger. A liner of drilled cotton 26 may be provided interiorly of first layer 20. This drilled cotton liner 26 makes glove 10 more comfortable to wear as it is gentle on the skin and also absorbs perspiration from the user's hand. The drilled cotton liner 26 is secured to first layer 20 in any suitable manner, however normally the cotton liner 26 is fitted to a mold and dipped into liquid rubber creating adhesion between the two. Further, alternative to drilled cotton liner 26, a liner of interlock or jersey cotton may be utilized to provide comfort for the user's skin.

The protective member 24 is integrally formed in glove 10 extending from a first end 40 over and around a distal tip region 22 of each finger region 16 to a second end 44. In the embodiment described above, protective member 24 is a hardened acrylic or hardened rubber however, other hardened materials used to protect the tip region 22 of each finger region 16 are entirely possible. For example, hardened polymers, Kevlar, hardened milled rubbers, and various other hardened non-metals may suffice. It may be undesirable in some instances to use a metal as protective member 24 because protective member 24 is designed to protect the tips of a user's fingers when inside the glove in the event the glove comes in contact with the metal blade on the skinner. The use of a metal protective member 24 contacting a rotating metal blade on the skinning device may damage the blade on the skinning device. However, it may be entirely possible to use a softer metal such as aluminum to fabricate protective member 24.

The first and second ends 40, 44 of protective member 24 terminate distally relative to a distal interphalangeal joint line 46. The interphalangeal line 46 is an imaginary line drawn at the location of the distal interphalangeal joint of a user's hand when the glove 10 is worn. The advantage of terminating protective member 24 distally from interphalangeal line 46 is that this design permits a user to continue to have a full range of motion in flexing the distal interphalangeal joint line 46 while protecting the tip regions 22 of their fingers with a solid protective member 24. The first and second ends 40,44 form a portion of an annular edge 41 defining an opening opposite a tip of the protective member 24, wherein the annular edge is positioned entirely distal of the interphalangeal line 46 associated with the first finger sleeve 16*a*. The annular edge 41 tapers towards the second end 40 of the protective member to thereby define a tapered surface 45.

Protective member 24 is integrally formed between first layer 20 and a second etched outer layer 28 (described in further detail below). In one embodiment, the integral formation of a protective member 24 sandwiched between first layer 20 and second layer 28 is accomplished by adhering protective member 24 to first layer 20 with an adhesive and then coating second layer 28 over first layers 20 and protective member 24. In other embodiments, no adhesive is needed to secure protective member 24 to first layer 20.

In accordance with another aspect of the present invention, the second layer 28 of etched material is provided exteriorly over first layer 20 across all of the finger regions 16, the thumb region 18, the palm region 14 and a portion of wrist region 12 adjacent palm region. The second layer 28 comprises a plurality of randomized alternating ridges 28*a* and valleys 28*b*. The ridges 28*a* and valleys 28*b* are oriented generally horizontally relative to a longitudinal axis "Y" (FIG. 1) of glove 10.

Figure 3:
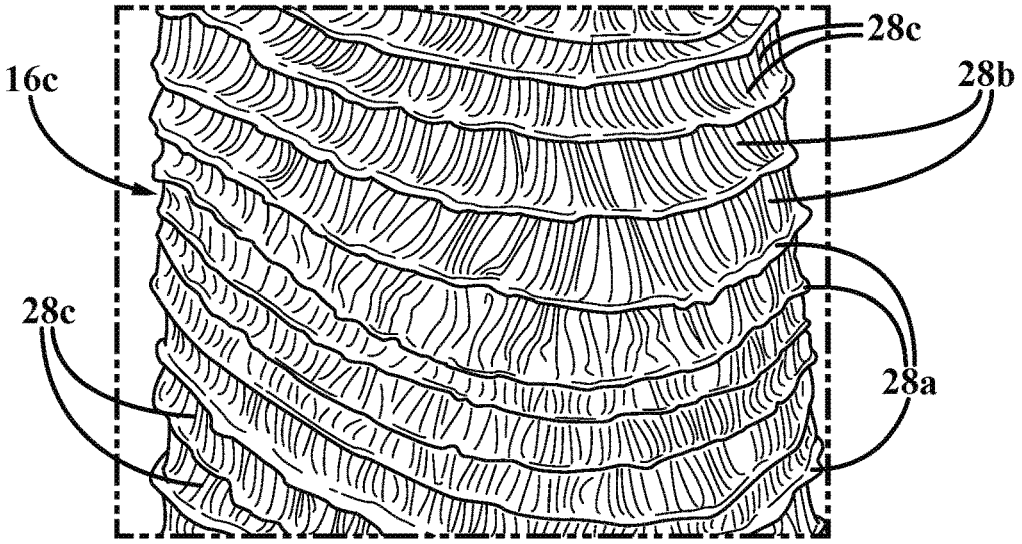
FIG. 3 is an enlarged front view of the highlighted region of FIG. 1 and showing the etched rubber on the exterior surface of at least part of the work glove.

In accordance with yet another aspect of the present invention, second layer 28 also includes a plurality of striations 28*c*, seen best in FIG. 3. Striations 28*c* are generally aligned with longitudinal axis "Y". Striations 28*c* extend across each individual valley 28*b* generally from one ridge 28*a* to the adjacent ridge 28*a*. The ridges 28*a*, valleys 28*b*, and striations 28*c* provides improved abrasion resistance to glove 10. The material of second layer 28 may be natural rubber that is milled, formed, and compressed rubber. The outer etching second layer 28 defining ridges 28*a*, valley 28*b*, and striations 28*c* defines a very rough outer surface of glove 10. The rough outer surface is advantageous in the meat packing industry to allow grease and water to drain through various channels defined by the valleys 28*b* and striations 28*c* so that glove 10 is less slippery, especially when working with pork and chicken. The etching of second layer 28 is formed as glove 10 is dipped in liquefied first layer and liquefied second layer material. It is entirely possible and foreseen that other methods of forming a rough surface around a protective member 24 would be entirely possible other than forming it through a dipped process.

Figure 5:
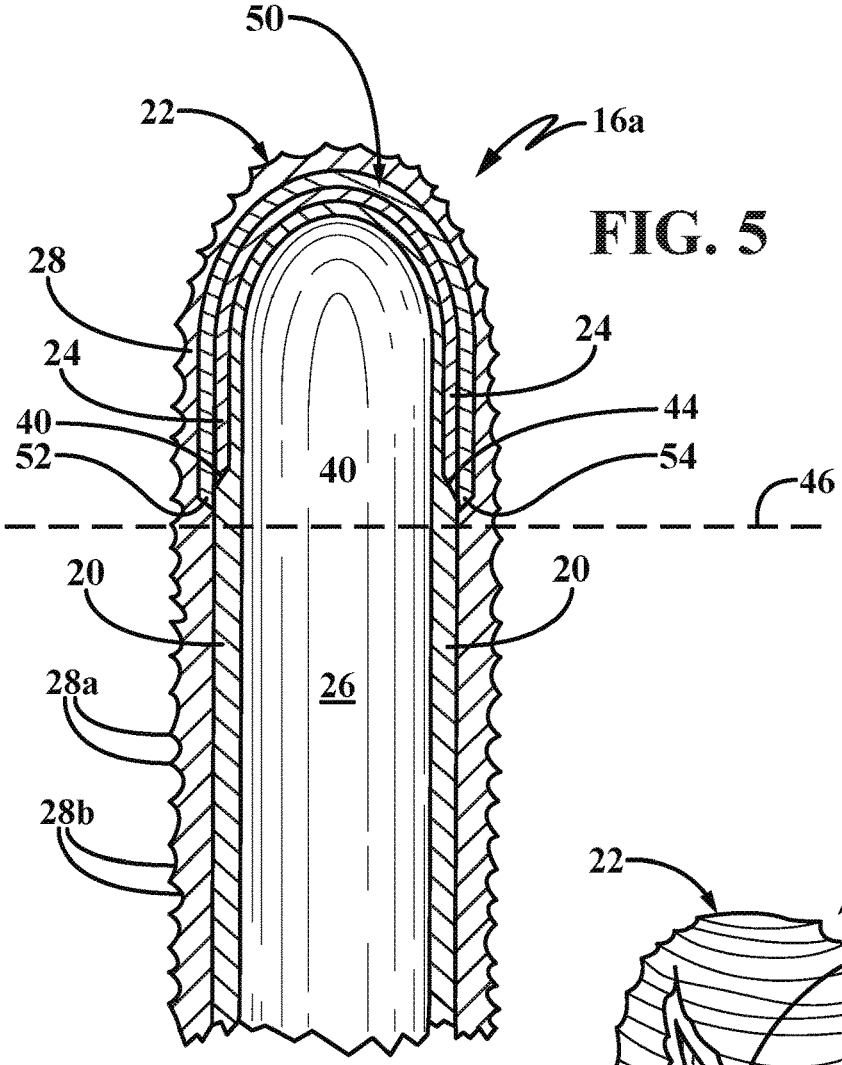
FIG. 5 is a longitudinal cross-section of a finger region of the work glove taken along line 4-4 of FIG. 2 including an indicator layer positioned between a flexible outer layer and a hardened layer.

As depicted in FIG. 5, another aspect of protective glove 10 includes an indicator layer 50. Indicator layer 50 extends from a first end 52 around the tip 22 to a second end 54. First end 52 and second end 54 of indicator layer 50 are both distal of interphalangeal joint 46. Indicator layer 50 is positioned between hardened protective member 24 and flexible outer second layer 28. Indicator layer 50 is preferably fabricated from acrylic in combination with styrene-butadiene rubber (SBR). Indicator layer 50 has a color that is different than that of flexible outer second layer 28 such that indicator layer 50 provides a visual indicator in the event that flexible outer second layer 28 is ripped or torn or otherwise broken. In one exemplary embodiment, indicator layer 50 is an orange color visually distinct from the color associated with outer flexible second layer 28.

While FIG. 5 details an embodiment of glove 10 having indicator layer 50 to provide a visual representation in the event the flexible outer second layer 28 is torn, it is entirely possible that an embodiment of FIG. 4 having only a hardened protective member 24 and a flexible outer second layer 28 is utilized and wherein the hardened protective member 24 is dyed a color different than that of the flexible outer second layer 28. If this version is employed, the hardened protective member 24 may be an orange thimble-like member that visually identifies a cut or tear or rip or otherwise break in the flexible outer second layer 28 of glove 10.

Figure 6:
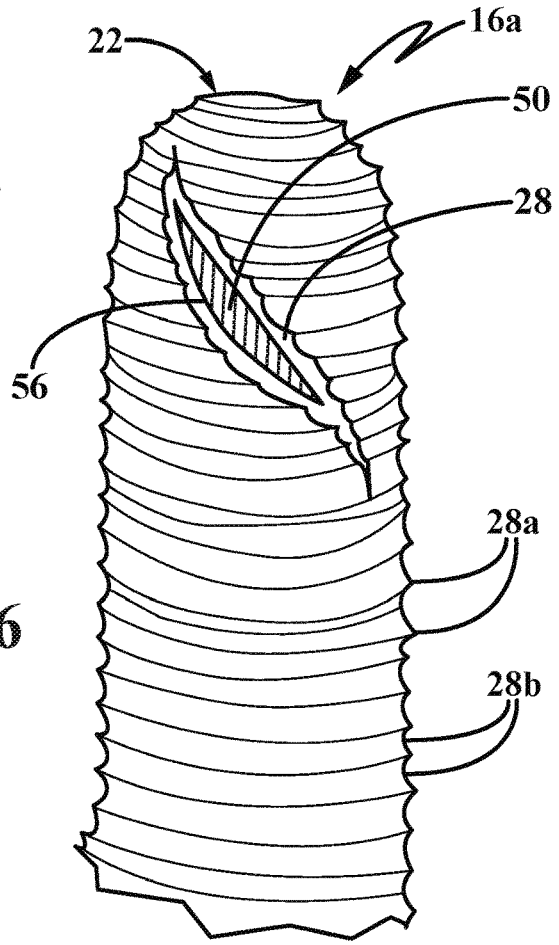
FIG. 6 is an enlarged elevation view of a finger region of the work glove detailing a rip or tear or cut in an outer flexible layer such that an indicator layer is visible to provide a visual identifier that the glove is broken and needs replaced.

As depicted in FIG. 6, an exemplary tear or rip 56 is shown near the tip of a finger region of glove 10. The tear or rip 56 extends entirely through flexible outer second layer 28 revealing indicator layer 50 there beneath. Indicator layer 50 shows itself through the aperture defined by tear 56 in order to provide a visual indicator to the user that the glove is broken and needs replaced.

It will be understood that the style of glove 10 illustrated in these figures is a hand-specific glove, but other styles of glove, such as puppet gloves or mitts may utilize include the features of glove 10 which provide improved abrasion resistance.

A pair of gloves 10 in accordance with the above description and figures was fabricated and tested for abrasion resistance. Glove 10 is fabricated by forming the liner of drilled cotton 26 over a mold in the desired shape or form of resultant glove 10. The drilled cotton liner 26 may then be dipped into a liquid solution of first layer 20 and then removed allowing first layer 20 to cool. Protective member 24 may be attached via an adhesive to the tip end 22 of first layer 20. Thus, protective member 24 may be pre-hardened and secured to glove. Alternatively, the cotton liner 26 and first layer 20 may have the finger tips 22 dipped into an acrylic or polymer solution and removed and cured to form protective member 24. Thereafter, portions of the glove having first layer 20 and protective member 24 adhered thereto may be dipped into a bath of liquid second layer material wherein second layer 28 is then permitted to cool. The milled features 28*a*, 28*b*, 28*c* of second layer 28 may be formed while second layer 28 cools and cures. Second layer 28 may be a natural rubber, Acrynitrile Butadiene Rubber, or Chloroprene. Similarly, first layer 20 may be a natural rubber, Acrynitrile Butadiene Rubber, or Chloroprene. Alternatively, first layer 20 and second layer 28 may also be pre-vulcanized latex.

When the layers are formed from pre-vulcanized latex, glove 10 may be dipped at least three times into the bath of liquid pre-vulcanized latex layer material. By dipping three times, glove 10 is formed thicker than conventional protective gloves in the meat packing industry. The thrice dipped thick glove 10 is semi-stiff or semi-rigid and less flexible than conventional protective glove. One exemplary, non-limiting advantage of a thrice dipped semi-rigid glove 10 is that the rigid form enables the glove to be removed from the hand (i.e., doffed) very quickly in the event of an emergency with the glove getting caught in the machine. The thick glove 10 having the wider first width 13 also assists with rapid removal of thick glove 10 in such an emergency.

In the embodiment of glove 10 that includes indicator layer 50 positioned between outer second layer 28 and the hardened protective member 24, the indicator layer 50 is applied over the hardened member 24. Then the glove with the indicator layer 50 is dipped into a liquid bath of the second layer 28 such that the dipping process seals indicator layer 50 therebetween the second layer 28 and the hardened protective member 24.

Once glove 10 is fabricated, a user dons the glove by inserting their hand into the interior portions of the glove contacting cotton liner 26. User may then grasp a piece of meat that needs skinned in a skinning device. When grasping the meat, the etched second layer 28 contacts the meat and provides a gripping surface with the plurality of randomized alternating ridges 28*a* and valleys 28*b*. Additionally, the material of first layer 20 and second layer 28 allow the user to flex their fingers to assist in the gripping of the meat. Further, with protective member 24 integrally formed between first and third layer entirely distal of the interphalangeal line 46, the tips 22 of a user's fingers are protected when manipulating the meat onto the skinning device while still allowing fingers to flex about the interphalangeal joint.

During the skinning process, the user guides the meat over a rotating blade narrowly exposed through a hole defined in a skinning table top (i.e., a deriding skinner machine). The user may rest the tips of the glove on the table top and move the piece of meat over the hole having the rotating skinning blades moving therein. In the event that tip region 22 of glove 10 comes into contact with the rotating blade, the protective member 24 made of hardened material will protect the tips of a finger in a thimble-like manner. Stated otherwise, protective member 24 may be generally cup-shaped to cover the tips of a wearer's fingers such that the cup-shaped protective member terminates between the base of a wearers finger nail and the interphalangeal joint. One exemplary and non-limiting deriding skinner machine is manufactured and commercially available for sale under the name "SK 15-340 Pork Skinner" by Marel hf of Reykjavik, Iceland.

Figure 7:
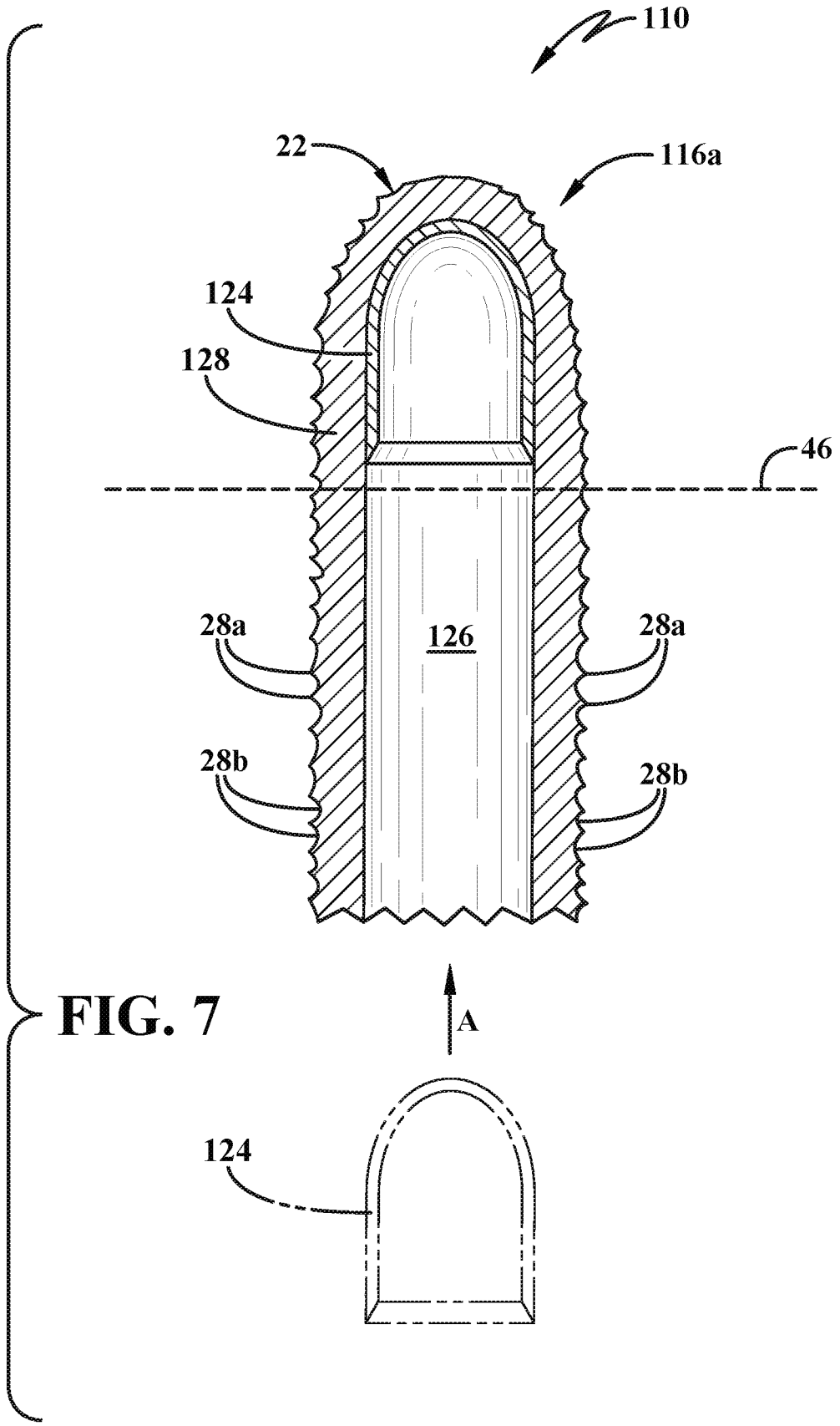
FIG. 7 is a cross section view of a finger region for an alternative embodiment glove having a protective member therein.

FIG. 7 depicts a first finger region 116*a* of a protective glove 110 in accordance with one aspect of an alternative embodiment of the present disclosure. Glove 110 is formed from a single layer 128 of flexible material. The single layer 128 may form similar rough surfaces (i.e., 28*a*, 28*b*) to provide suitable grip during the meat handling process. However, unlike glove 10 which has an integrally formed protective member 24, glove 110 is designed to utilize a protective member 124 which may be retrofitted to an existing protective glove. Stated otherwise, glove 110 is formed by retrofitting an ordinary and usual non-slip glove utilized in the meat packing industry with the protective member 124 inserted into the fingertip region. FIG. 7 depicts the step of retrofitting an ordinary meat packing protective glove into glove 110 by inserting protective member 124 into the fingertip in the direction of Arrow A.

Protective member 124 may fit into the inner surface of layer 128 via a frictional interference fit, or may be attached with a thin layer of adhesive. Alternatively, protective member 124 may fit interiorly of a liner 126 and be connected thereto. In each instance, protective member 124 is shaped similar to a thimble and has an end that terminates distally from imaginary interphalangeal joint line 46, similar to that of glove 10.

Figure 8:
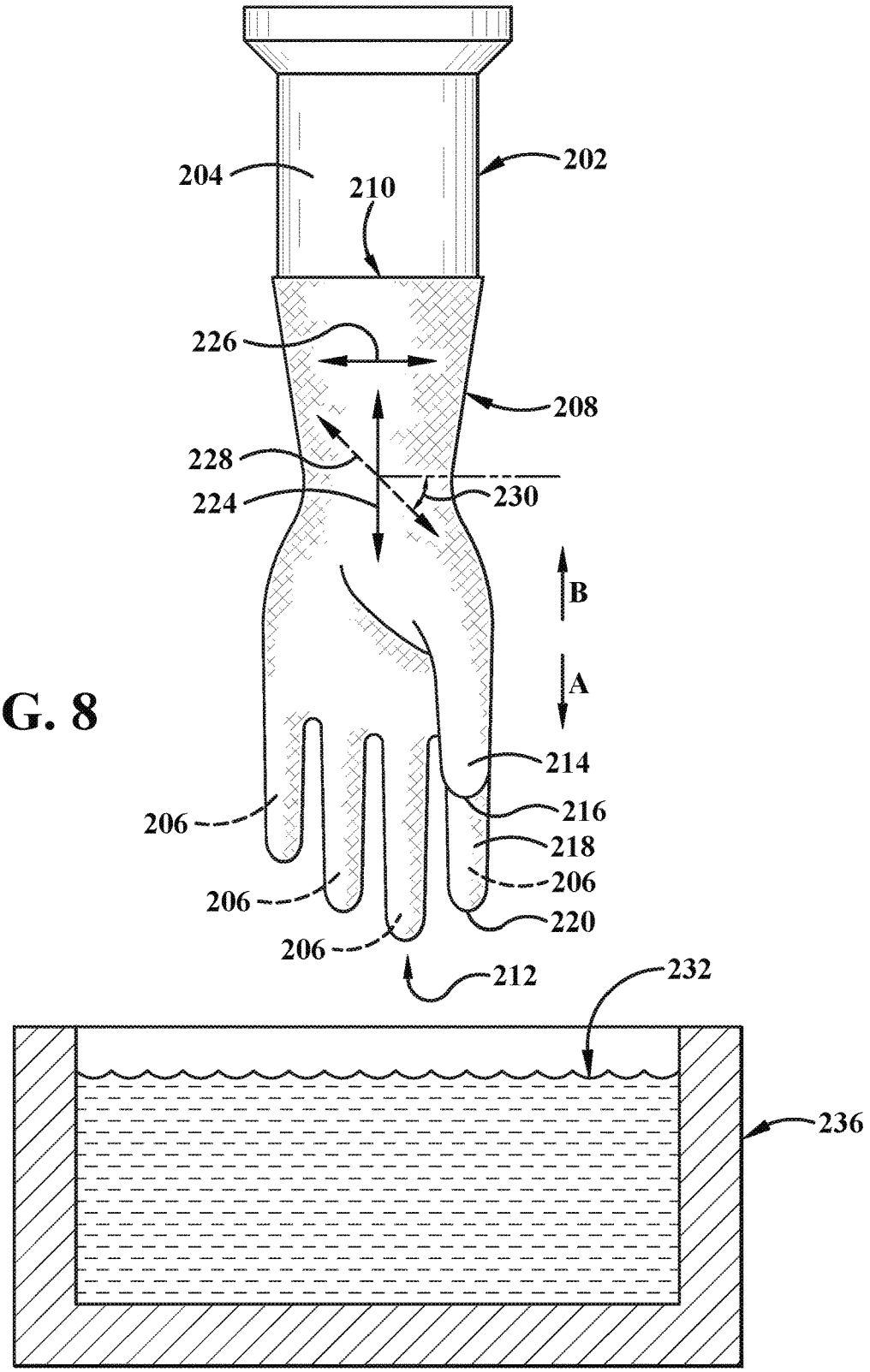
FIG. 8 is a diagrammatic operational elevation view of a liner being dipped into a liquefied material that cures to form the protective member in accordance with another embodiment of the present disclosure.
Figure 11:
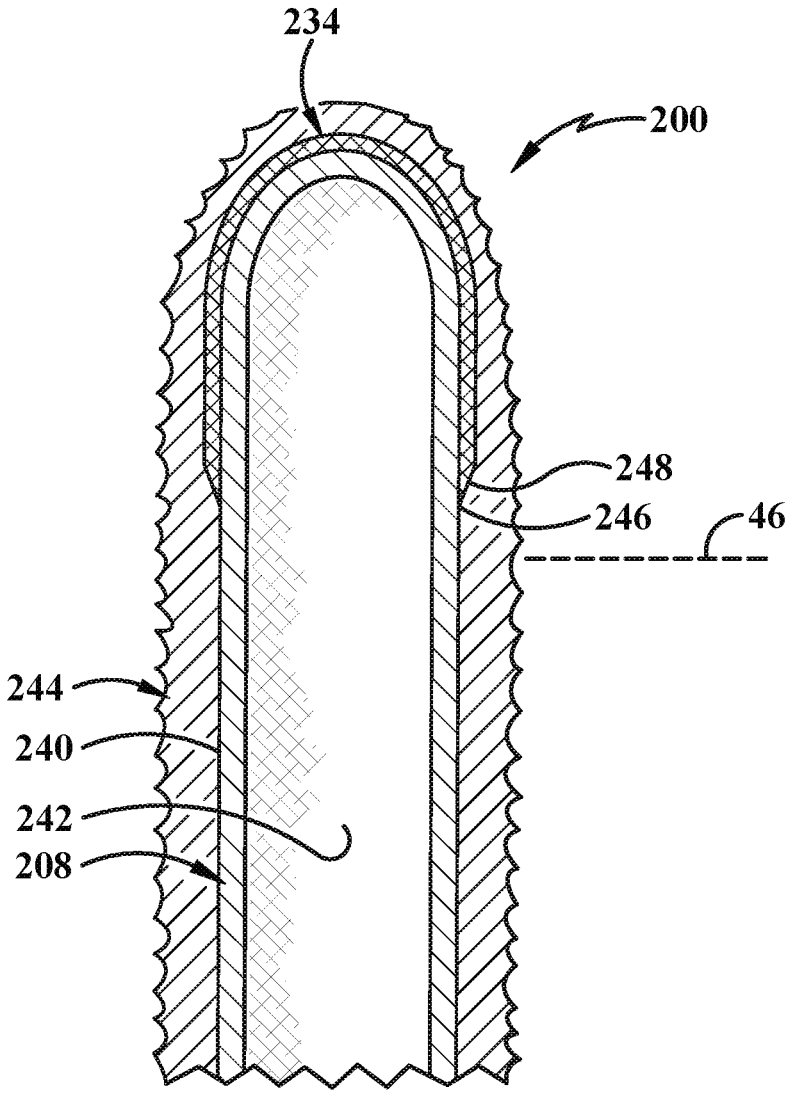
FIG. 11 is cross section of one finger sleeve depicting the protective member disposed between the liner and the outer layer and being hardened relative to the same.

FIG. 8 schematically depicts a portion of the method used to formulate a protective article or glove in accordance with a second embodiment of the present disclosure. A cross-section of one finger of a glove or one portion of the article formed in accordance with this alternative embodiment is shown as 200 (FIG. 11). For example, this exemplary embodiment may refer to a protective article comprising: a first end opposite a second end; a liner adapted to receive objects therein; an outer layer connected with the liner; and a protective member adjacent the second end that transitions from a liquid state to a solid state while forming the protective article. Further, the protective member in a solid state is positioned between the liner and the outer layer. In this scenario, the protective article may refer to any device that may protect something else that is disposed within the protective article. For example, as shown, the protective article may be a protective glove. However, it is possible that the protective article be other devices than a glove. For example, the protective article may be a mitten, shirt, jacket, hat, belt, shoe, sock, goggle, mask. However, the protective article need not be a wearable item. For example, the protective article may be any article of manufacture, such as a protective box, container, vessel, chest, or canister. However, any other article of manufacturer is entirely possible.

With continued reference to FIG. 8, a mold 202 may include a base 204 and a plurality of finger shaped extensions 206 so as to define the shape of a hand which will ultimately define the shape of the glove 200 of the alternative embodiment. A liner 208 is fitted to the mold 202 so as to form the shape of a glove 200.

The liner 208 includes a proximal end 210 and a distal end 212 defining a longitudinal direction therebetween of the glove 200. Liner 208 may include a thumb portion 214 having a distal tip 216, a first finger portion 218 having a distal tip 220. The liner 208 may include additional finger portions, such as for a middle, index, and pinky fingers each having their own respective distal tip. The distal tip 220 on the index finger portion 218 is positioned distally from the distal tip 216 of the thumb portion 214.

The longitudinal direction of the glove defined by the liner 212 is shown generally as arrow 224 which extends between the proximal end 210 and the distal end 212 of the liner.

The liner 208 may be fabricated from either cotton or a polyester-cotton blend. Regardless of the cotton or polyester-cotton blend material that defines liner 208, the liner 208 is a two-way stretch fabric. The term two-way stretch fabric refers to a fabric that stretches in only one direction, usually from selvedge to selvedge thereof. The direction in which the liner 208 stretches is indicated by arrow 226. As shown in FIG. 8, according to one aspect the two-way stretch direction of the liner 208 is orthogonal to the longitudinal direction 224 of the liner 208. In one particular aspect, the liner 208 does not stretch in the longitudinal direction 224. In accordance with this exemplary aspect, a non-limiting advantage for providing a single direction (i.e., two-way stretch) that is orthogonal to the longitudinal direction 224 of the liner 208 is that if the glove 200 is donned and used in a skinning process, as described above, and the glove is rapidly doffed by being caught by a rotating mechanical blade, it is desirable to reduce any stretch or give in the glove 200. Stated otherwise, by orienting the stretch direction 226 orthogonal to the longitudinal direction of the glove 224, it enables the liner 208 to not stretch as it is pulled off. This enhances the rigidity and structure of the glove 200 and may improve safety in some exemplary aspects. It should be noted that the present disclosure is not indicating that the operator should not exercise maximum caution when donning glove 200 because of the stretch orientation (in the direction of 226) which is orthogonal to the longitudinal direction of the glove of the liner 208, but rather that orienting the stretch direction 226 orthogonal to the longitudinal direction of the liner 208 may be beneficial to enhance some rigidity of the liner 208 as it is doffed. In another particular embodiment, the stretch direction of the liner 208 may not be orthogonal to the longitudinal direction 224 of the liner 208. However, it is envisioned that the stretch direction of the liner 208 is not parallel to the longitudinal direction 224 of the liner 208. For example, the stretch direction of the liner 208 may be angled or skewed relative to the longitudinal direction 224 of the glove 200. In one particular embodiment, the stretch direction of the liner 208 may be in a range from orthogonal (i.e., 90 degrees) to about 15 degrees, 10 degrees, or 5 degrees relative to the longitudinal direction 224 of the glove.

In another particular embodiment, if the stretch direction of the liner 208 is not orthogonal to the longitudinal direction 224 of the liner 208, then it would be greater than about 45 degrees relative to the longitudinal direction 224. For example, an alternative stretch direction is indicated by arrow 228 that defines an angle 230 between the stretch direction arrow 228 and the longitudinal direction 224 of the liner 208. Angle 230 may be less than about 45 degrees. In one particular embodiment, angle 230 is in a range from about 45 degrees to about 10 degrees. As indicated in FIG. 8, as angle 230 decreases, the stretch direction 228 of the liner 208 approaches orthogonal relative to the longitudinal direction 224 of the liner 208.

With continued reference to FIG. 8, the liner 208 supported by the mold 202 may be dipped into a liquefied bath 232 of a material that will cured to form the protective member inside the glove 200. As indicated in previous embodiments, the protective member is configured to be located distally from interphalangeal joint 46 so as to protect the distal tip 222 of the finger portions 206. In those previous embodiments, the finger protectors were hardened members, such as metal or rubber or other materials that are hardened relative to the external portion of the glove.

FIG. 8 depicts the formation of a protective member, such as protective member 234 (FIG. 11). With the liner 208 attached to the mold 202, the assembly may be lowered in the direction of arrow A so as to dip the distal tips 220 and 216 of the respective portions of the liner 208 into the liquefied bath of material 232 that will ultimately result in the formation of the protection member 234. Stated otherwise, the material 232 is first in a liquid state. In one particular embodiment, the liquefied material 232 may be a water-based synthetic elastomer copolymer. In another particular embodiment, the protective member 234 may be formed from the material 232 which may be a liquefied natural rubber. In each instance, the liquefied material 232 may be maintained at a temperature during the dipping process to keep the liquefied material 232 in liquid form. Accordingly, a container 236 may have sufficient heating elements cooperating therewith so as to maintain the material 232 in liquid form. Once the liner 208 and the mold 202 have been lowered in the direction of arrow A, the tip regions, namely, the distal tips 220 and 216, are coated with the liquefied material. The liner 208 and the mold 202 are raised in the direction of arrow B which opposite that of arrow A.

With continued reference to FIG. 8, the liquefied material 232 may be formed from an acrylic material or may consist essentially of acrylic polymers or monomers.

Figure 9:
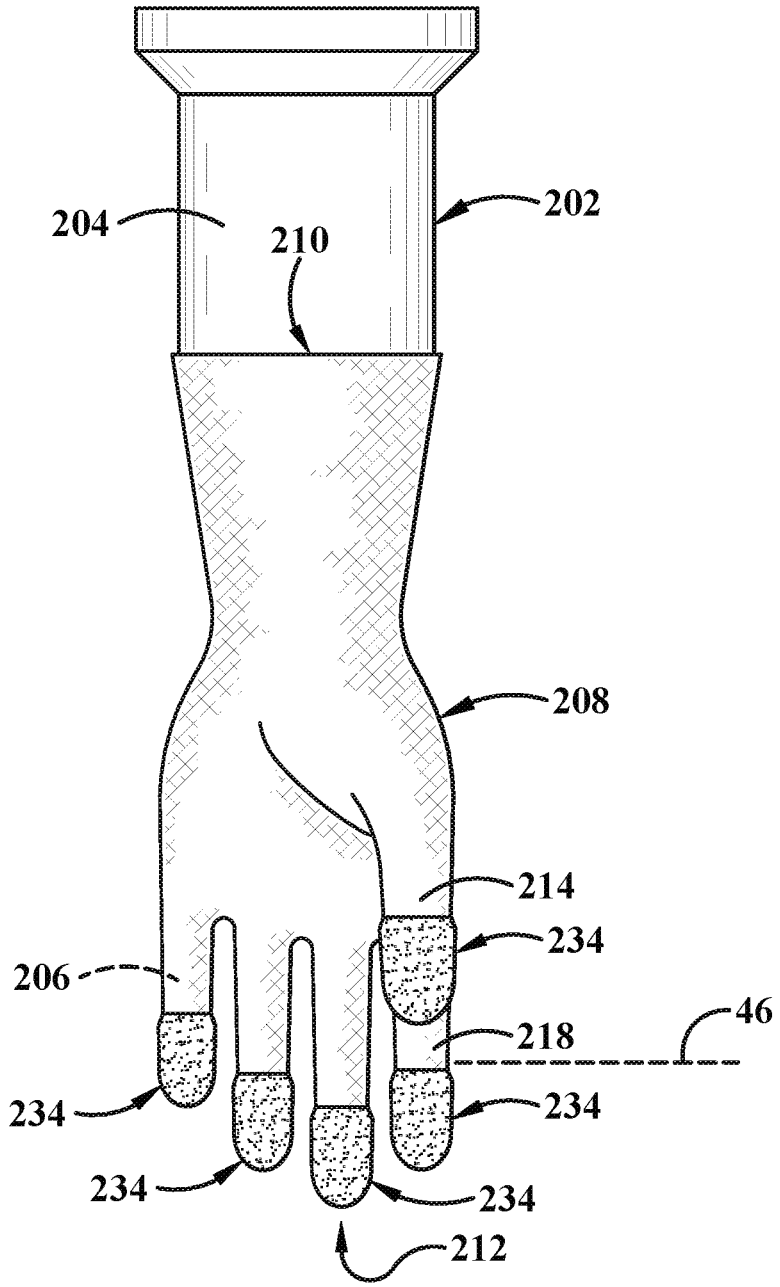
FIG. 9 is an inverted elevation view of the liner having cured protective member originally formed form liquefied material covering the distal tips of the finger sleeves of the liner.

FIG. 9 depicts the protective members 234 being attached to the liner 208 after being removed from the liquefied material 232. The liquefied material 232 is allowed to cool and cure so as to define a hardened member in order to protect the fingertips of a wearer or operator. Further, it is envisioned that the liner 208 will remain on the mold 202 while the protective members 234 are allowed to cure into their hardened state. When cured, the protective members 234 terminate distally from the interphalangeal joint line 46. Stated otherwise, material 232 transitions from the liquid state to a solid state during formation of glove 200.

With continued reference to FIG. 9, when the protective members 234 are formed from the material 232 that includes a polymer or monomer, the curing process may occur over a period of time sufficient to impart sufficient rigidity to the protective member 234. In one particular embodiment, the liner 208 on the mold 202 is cured in a standard curing environment over a period of time that enables the protective member 234 to at least partially cure. Alternatively, other embodiments may enable a full cure of the protective member. Protective member, namely, the material 232 forming the protective member in some instances may strike through the liner 208. However, in other embodiments, it is possible to fabricate the liner 208 from a material so as to prevent the material 232 forming the protective member 234 from striking through the liner 208.

Figure 10:
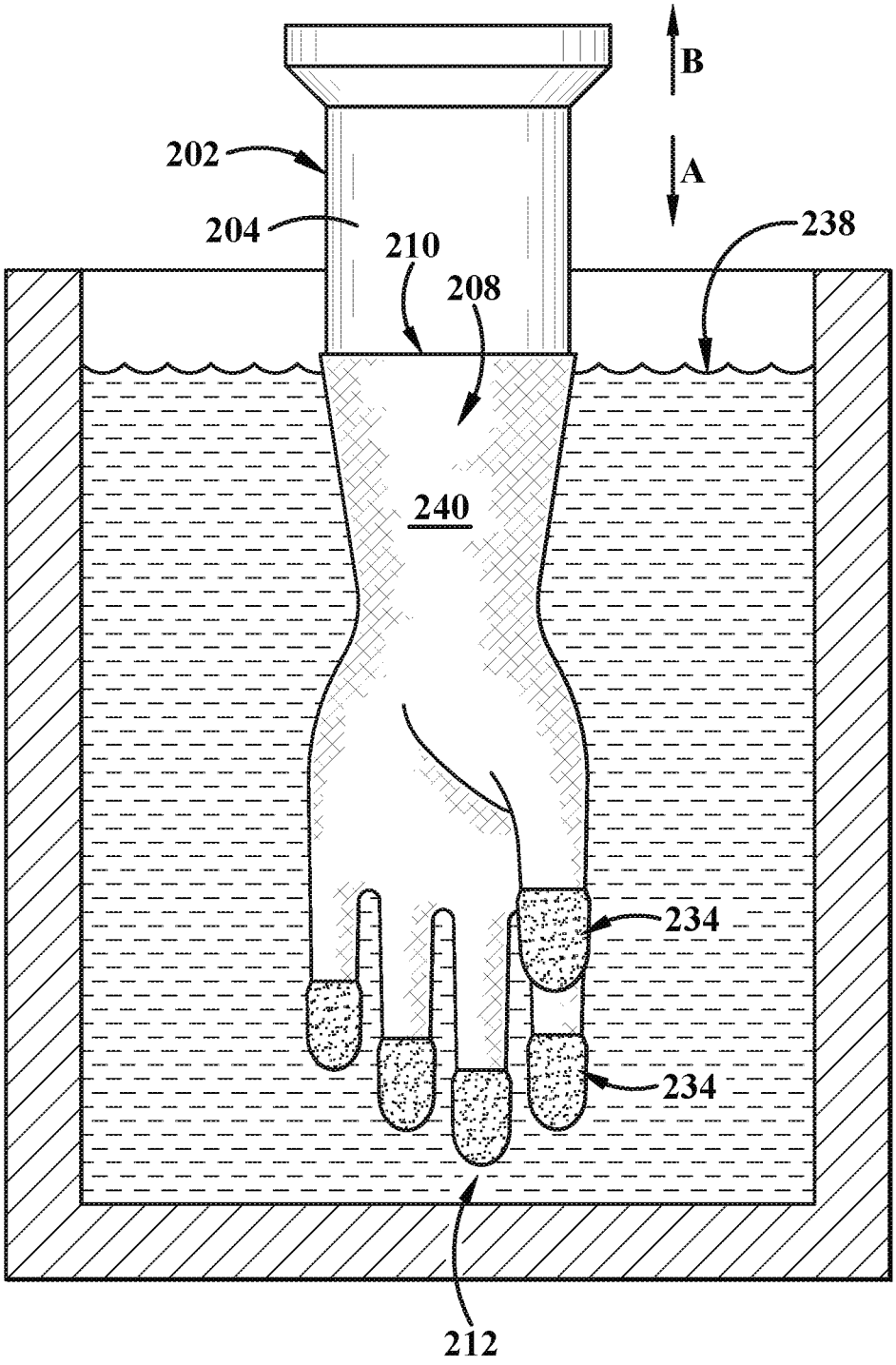
FIG. 10 is a diagrammatic operational elevation view of the liner and protective members being dipped into a liquefied bath of material that will form the outer layer or outer surface of the resultant protective glove.

FIG. 10 depicts the mold 202 having the liner 208 with the at least partially cured protective members 234 being dipped into a liquefied bath of material 238 which will ultimately form the outer layer of the glove 200. The mold 202 carrying the liner 208 and the protective members 234 is dipped downwardly in the direction of arrow A such that the depth of the dipping is adjacent the proximal end 210 of the liner 208. The material 238 adheres, connects, or otherwise attaches to the liner 208 along its outer surface 240. Furthermore, the material 238 attaches and connects to the outer surface of the protective member 234. Accordingly, the material 238 in its liquefied state should be a sufficient material that will attach equally well to both the liner 208 and the protective member 234 even though the liner 208 and the protective member 234 are formed from different materials.

FIG. 11 depicts a cross-section of the index finger portion 206 of the glove 200. The liner 208 defines an inner cavity 242 configured to receive a finger therein. Collectively, the liner 208 attached with an outer layer 244 formed from the material 238 define a finger sleeve. The protective member 234 is positioned between the liner 208 and the outer layer 244. In one particular embodiment, the protective member 234 extends over and around the distal tip 216 of the liner 208 and extends proximally to a terminal end 246 which formed with a tapered slope 248 that forms as a result from the dipping process identified in FIG. 8. The tapered slope 248 tapers proximally relative to the interphalangeal joint line 46. Stated otherwise, the outer surface of the protective member 234 slopes and narrows downwardly towards the liner 208.

Figure 12:
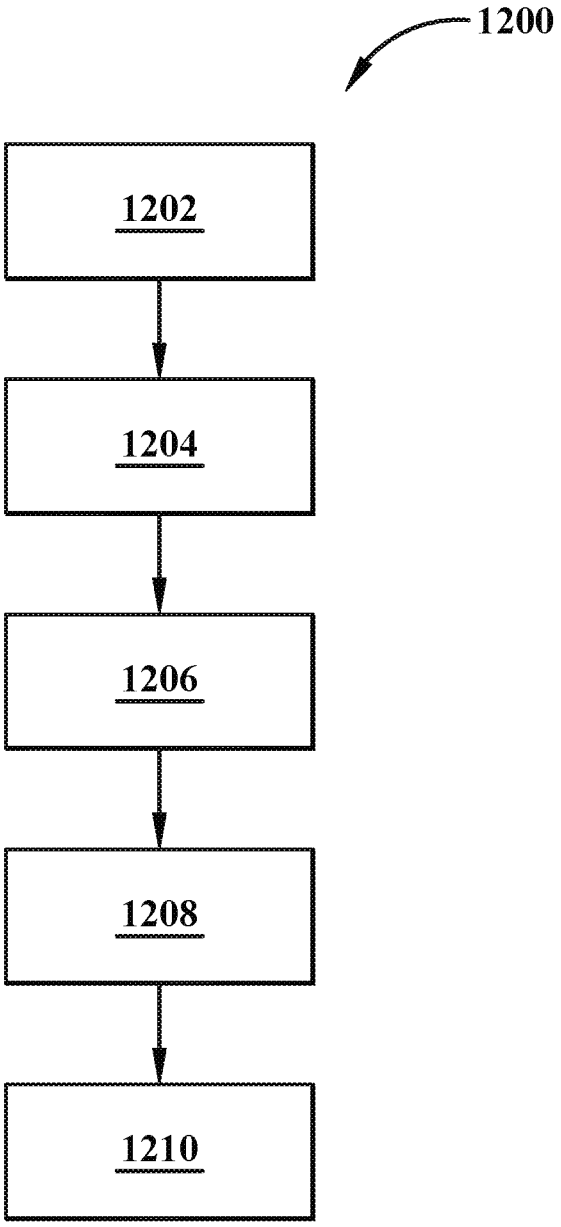
FIG. 12 is a flow chart depicting an exemplary method in accordance with one aspect of the present disclosure.

FIG. 12 depicts the method of forming a glove generally at 1200. Method 1200 may include attaching the glove liner 208 to the glove mold 202, which is shown generally at 1202. Method 1200 may include dipping the liner 208 into a liquid first material 232, which is shown generally at 1204. Method 1200 may include curing the liquid first material 232 to form solid first material (i.e., the protective member 234), which is shown generally at 1206. Method 1200 may further include dipping the liner 208 and the solid first material (i.e., protective member 234) into a liquid second material 238, (such as will define the outer layer 244), which is shown generally at 1208. Method 1200 may include curing the liquid second material 238 to form a flexible solid second material (i.e., the outer layer 244) with the solid first material (i.e., the protective member 234) disposed between the liner 208 and the flexible solid second material or outer layer 244, and wherein the solid first material is hardened relative to the liner 208 and the flexible solid second material or outer layer 244, which is shown generally at 1210. Method 1200 may further include forming a first finger sleeve portion of the glove with the liner; and dipping the liner into the liquid first material without extending beyond an interphalangeal joint line of the first finger sleeve. Method 1200 may further include withdrawing the liner from the liquid material; and forming a tapered end of the solid first material after withdrawing the liner from the liquid material. Method 1200 may further include wherein the liner consists of a two-way stretch, and orienting the two-way stretch of the liner at an angle that is not parallel to a longitudinal direction of the glove; or orienting the two-way stretch of the liner orthogonal to the longitudinal direction of the glove; or orienting the two-way stretch of the liner at an angle in a range from about 30 degrees to about 60 degrees relative to the longitudinal direction of the glove.

Figure 13:
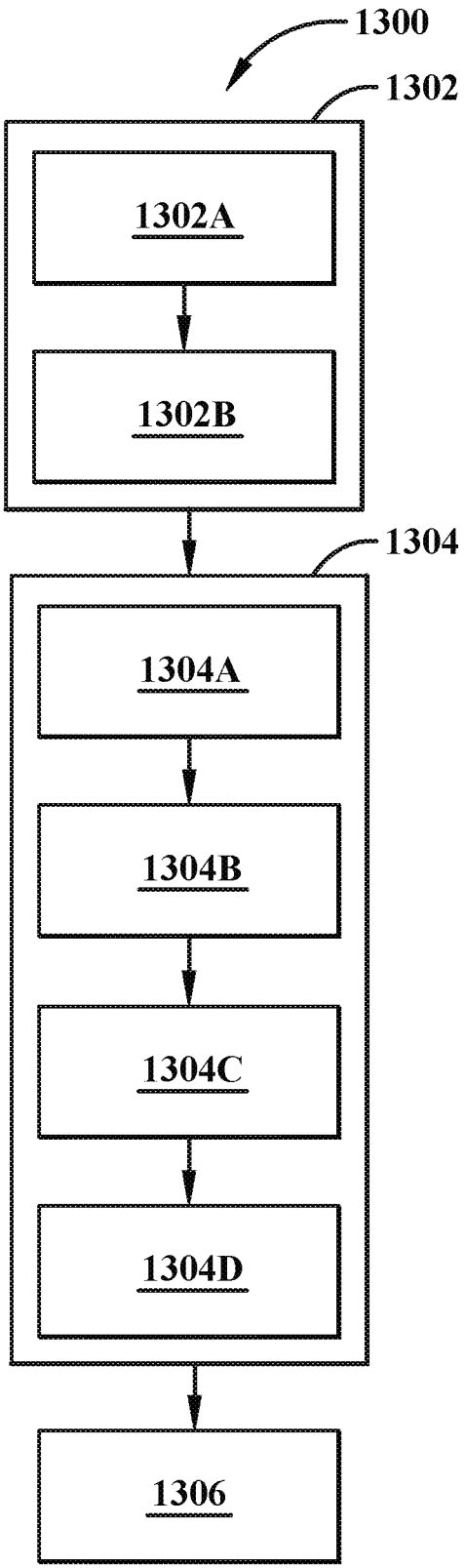
FIG. 13 is a flow chart depicting another exemplary method in accordance with one aspect of the present disclosure.

FIG. 13 depicts another exemplary method 1300 for forming a protective glove or mitten that is applicable to both glove 10 and glove 200. The method 1300 of manufacture of the process to form the outer surface material layer 244 or second layer 28 is described in detail below. The inner liner 240 or first layer 20 carrying the protective member 234 or 24 may be dipped into a tank containing an aqueous polymeric emulsion that has been heated and stirred, which is shown generally at 1302. In an exemplary embodiment the outer surface material 244 or second layer 28 may be foamed, which is shown generally at 1304. The outer surface material 244 or second layer 28 can use a foam mixture. The liner 240 or first layer 20 carrying the protective member 24 may then be washed and heated to a vulcanization temperature to cure second layer 28, which is shown generally at 1306. Additional washing may occur depending on the desired implementation of the glove.

In an exemplary embodiment when latex is used as the aqueous polymeric emulsion that has been heated and stirred in step 1302 the temperature is in the region of 18-20° C. This may be achieved by using high displacement impellers to circulate the latex along the bottom of a tank past heat exchangers made from stainless steel a dimple plate, which is shown at 1302A. The latex is then allowed to rise past a battery of high speed whipping stirrers which assist in maintaining foam quality, and then across the surface of the latex in the tank at a speed similar to the speed of travel of the inner liner or first layer 20 with the protective member 24 as they were passed through the tank, which is shown generally at 1302B.

When the latex or other such polymer is foamed at step 1304, the air content is typically in the 5 to 50% range on a volume basis. The polymeric latex emulsion may contain additional surfactants such as Tween® 20 to stabilize the foam, which is shown generally at 1304A (Note: The "20" in Tween® 20 is the commercial name, the "20" in this instance is not a reference element and is not to be confused with first layer 20). Tween® 20, or Polysorbate 20, is a useful choice for biochemical applications. With a hydrophobic dodecanoic tail, it is attached to twenty repeat units of polyethylene glycol and distributed across four different chains. As a non-ionic surfactant, Polysorbate 20 has a molecular weight of 1,225 daltons, assuming twenty ethylene oxide units, one sorbitol, and one lauric acid as the primary fatty acid. The ethylene oxide subunits are responsible for the hydrophilic nature of the surfactant, while the hydrocarbon chains provide the hydrophobic environment. Ethylene oxide polymers attach to the backbone ring, which is formed by sorbitol. It is also miscible in water (100 mg/ml) and yields a clear, yellow solution. It is practically insoluble in liquid paraffin and fixed oils, and also miscible in alcohol, dioxane, and ethyl acetate.

Once the latex is foamed with the desired air content and the viscosity may be adjusted, which is shown generally at 1304B. Refinement of the foam occurs by using the desired whipping impeller stirrer driven at a first desired speed, which is shown generally at 1304C. Then, the air bubble size is refined through use of a different impeller run at a second desired speed, reduced from the first desired speed, which is shown generally at 1304D. The air cells reduce the modulus of elasticity of the polymeric coating increasing the flexibility of the glove 10. In an exemplary embodiment when the air content is in the range of 5-15 volumetric percentile foams that have closed air bubbles and the polymeric latex coating forming second layer 28 is liquid impervious. This coating has a spongy soft feel to the human touch.

Some of the air bubbles adjacent to the external surface open out providing increased roughness and have the ability to remove boundary layer of oil, grease, and water from a gripping surface, providing increased grip. The resultant configuration caused from the cured air bubbles on the external surface of outer surface material layer 244 or second layer 28 enable a shape that opens outward and are located above the protective member 234 or 24. The resultant configuration caused from the cured air bubbles are defined by an edge that is shaped and provides a structure similar to the lateral ridges shown in other embodiments. The edge of the resultant configuration caused from the cured air bubbles enables the edges to bound a depression or valley that is similar to the valley region shown in other embodiments. The resultant configuration caused from the cured air bubbles may also have other artifacts of cured formed that result in striations that span across the valleys similar to other embodiments. Creating such a structural configuration in the resultant configuration in the outer surface material layer 244 or second layer 28 caused from the cured air bubbles may be accomplished by controlling the amount of foaming (such as volumetric air content) and the parameters of the curing process. Conversely, in another embodiment, when the volumetric air content is in the range of 15-50%, the air bubbles are adjacent to each other and during a vulcanization heating step expand to a point where they cells touch each other creating an open celled foam.

The dipping and curing may be controlled so that the cured layer includes a surface film of substantially solid latex, apart from perforations where the bubbles were located. In general, this control is achieved by setting appropriate dip line speeds. Depending on the desired implementation, an exemplary embodiment provides for machines that move the dip line in the range of 4-14 ft/min, and oven temperatures in the range 95-155° C. in order to cure the outer surface material layer or second layer 28. These rates and temperatures are adjusted to optimize the foam parameters for the desired implementation.

In exemplary embodiments, the desired properties of the outer surface material layer 244 or second layer 28 of the glove 200 or 10 can be tailored to the desired use depending on the size of the openings in the air cell and by optionally applying an aqueous fluorochemical dispersion coating. The dispersion generally consists of fluorochemical composition dispersed in an aqueous solvent medium to form a coating that is typically 0.5 to 2 micron in thickness. The aqueous fluorochemical dispersion coating may also be applied to portions of the that is not covered by the polymeric latex coating. The fluorochemical coating may be applied to the gelled latex prior to vulcanization and the coating cures together with the latex polymer. The fluorochemical coating may be equally well applied to unfoamed coating to prevent oil or water penetration through occasional imperfections in the latex coating of the glove.

Further information regarding treatment of foams may be found in U.S. Pat. Nos. 8,192,834, 8,001,809, and 7,814,571, which are incorporated by reference in their entireties.

Additional treatments may occur with the glove, including rinsing the glove with solvents such as xylene, toluene, trimethylbenzene (pseudocumene), phenol, thiophene, pyridine and non-aromatic hydrocarbons. This may occur in order to allow the glove to have additional texture or ridges depending on the desired implementation.

Figure 14:
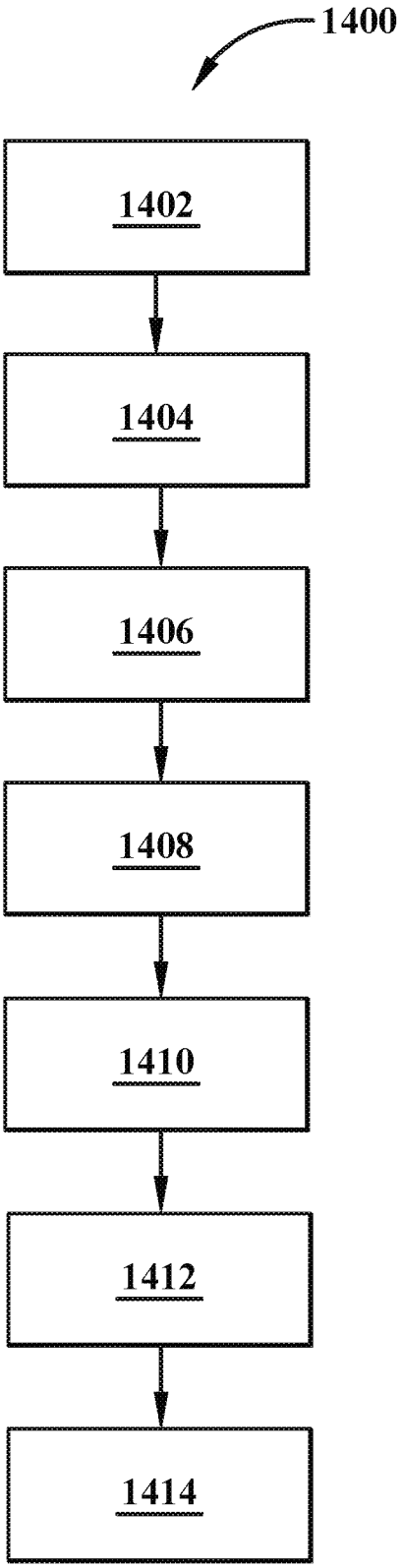
FIG. 14 is a flow chart depicting another exemplary method in accordance with one aspect of the present disclosure.

FIG. 14 is a flow chart that depicts another exemplary method of the present disclosure, shown generally at 1400. Method 1400 includes attaching a glove liner to a glove mold, which is shown generally at 1402. Method 1400 includes connecting a protective member to the glove liner and positioning the protective member distally from an interphalangeal joint line, wherein the protective member is harder than glove liner, which is shown generally at 1404. Method 1400 includes heating and stirring an aqueous polymeric emulsion, which is shown generally at 1406. Method 1400 includes foaming the aqueous polymeric emulsion, which is shown generally at 1408. Method 1400 includes dipping the glove liner and protective member into a tank containing the aqueous polymeric emulsion that has been heated, stirred, and foamed, wherein the protective member is fully submerged into the tank while dipping the glove liner and protective member, which is shown generally at 1410. Method 1400 includes removing the glove mold that carries the glove liner and protective member from the tank, which is shown generally at 1412. Method 1400 include curing the aqueous polymeric emulsion on the glove liner above the protective member to result in a glove having a textured outer surface defining a grip surface above the protective member that is adapted to assist with grip ability for a boundary layer of oil or grease on the grip surface, wherein the protective member is harder than the cured aqueous polymeric emulsion, which is shown generally at 1414.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

Stretch fabric is a synthetic fabric which stretches. Stretch fabrics are either 2-way stretch or 4-way stretch. 2-way stretch fabrics stretch in one direction, usually from selvedge to selvedge (but can be in other directions depending on the knit). 4-way stretch fabrics, such as spandex, stretches in both directions, crosswise and lengthwise.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral" and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A method comprising:

attaching a glove liner to a glove mold;

connecting a protective member to the glove liner and positioning the protective member distally from a portion of the first finger sleeve corresponding to an interphalangeal joint, wherein the protective member is harder than glove liner;

connecting a protective member to the glove liner in the thumb-crotch region;

dipping the glove liner and the protective member into a tank containing an emulsion, wherein the protective member is fully submerged into the emulsion within the tank while dipping the glove liner and protective member;

removing the glove mold that carries the glove liner and the protective member from the tank; and curing the emulsion above the glove liner and above the protective member to result in a glove having a textured outer layer defining a grip surface, wherein curing the emulsion on the glove liner to result in the glove having the textured outer layer defining the grip surface further comprises forming a lateral ridge in the textured outer surface above the protective member.

2. The method of claim 1, further comprising:

forming a valley in the textured outer surface between the lateral ridge and an adjacent lateral ridge, and above the protective member located distally from the interphalangeal joint.

3. The method of claim 2, further comprising:

forming a striation that extends across the valley between adjacent lateral ridges, and above the protective member, wherein the striation extends in a generally longitudinal direction associated with the finger sleeve.

4. The method of claim 3, further comprising:

dipping the glove liner into a liquid first material;

curing the liquid first material to form the protective member that is a solid first material when cured.

5. The method of claim 4, further comprising:

forming the first finger sleeve of the glove with the glove liner;

dipping the glove liner into the liquid first material without extending beyond the interphalangeal joint;

withdrawing the glove liner from the liquid material; and forming a tapered end of the solid first material after withdrawing the liner from the liquid material.

6. The method of claim 1, wherein the lateral ridge is aligned in direction that extends around a circumference of the first finger sleeve on the glove.

7. The method of claim 1, wherein the emulsion is an aqueous polymeric emulsion.

8. The method of claim 1, further comprising foaming the emulsion.

9. The method of claim 1, further comprising stirring the emulsion.

10. The method of claim 1, wherein the lateral ridge is formed as a shape that opens outward.

11. The method of claim 1, further comprising:

applying a colored layer onto the protective member.

12. The method of claim 1, wherein curing the emulsion on the glove liner is accomplished by washing and heating to vulcanization temperature the emulsion while connected to the glove liner.

13. The method of claim 1, further comprising heating the emulsion to a temperature in a range from about 18° C. to about 20° C.

14. The method of claim 1, wherein the emulsion comprises latex, further comprising:

circulating latex along a bottom of the tank past one or more heat exchangers; and enabling the latex to rise past a whipping stirrer.

15. The method of claim 1, further comprising:

maintaining air content of foam in the emulsion in a range from 5% to 50% on a volume basis; and adding a surfactant to stabilize the foam, wherein the surfactant comprises a hydrophobic dodecanoic tail.

16. The method of claim 15, further comprising adjusting the viscosity of the foam, wherein adjusting the viscosity of the foam comprises:

driving an impeller at a first desired speed; and refining a size of an air bubble in the foam by driving the impeller at a second desired speed that is reduced from the first desired speed.

17. The method of claim 1, further comprising:

reducing a modulus of elasticity of the emulsion from a higher value when liquid to a lower value when cured.

18. The method of claim 1, wherein the textured outer layer is formed by steps comprising:

providing air bubbles adjacent to the outers surface that open outward when cured thereby providing increased roughness.

* * * * *